US011761229B1

(12) United States Patent
Hale

(10) Patent No.: US 11,761,229 B1
(45) Date of Patent: Sep. 19, 2023

(54) TENT COVER SYSTEM AND METHOD OF USE

(71) Applicant: Alan Hale, Cypress, TX (US)

(72) Inventor: Alan Hale, Cypress, TX (US)

( * ) Notice: Subject to any disclaimer, the term of this patent is extended or adjusted under 35 U.S.C. 154(b) by 0 days.

(21) Appl. No.: 17/530,221

(22) Filed: Nov. 18, 2021

Related U.S. Application Data

(60) Provisional application No. 63/120,352, filed on Dec. 2, 2020.

(51) Int. Cl.
*E04H 15/54* (2006.01)
*E04H 15/64* (2006.01)
*E04H 15/56* (2006.01)

(52) U.S. Cl.
CPC ..... *E04H 15/54* (2013.01); *E04H 15/56* (2013.01); *E04H 15/64* (2013.01)

(58) Field of Classification Search
CPC ..... E04H 15/54; E04H 15/56
See application file for complete search history.

(56) References Cited

U.S. PATENT DOCUMENTS 2,627,864 A * 2/1953 Baker ..... E04H 15/56 135/120.1
5,421,355 A * 6/1995 Cantwell ..... E04H 15/425 135/120.3
7,320,332 B2 * 1/2008 Reis ..... E04H 15/44 135/147
8,763,621 B2 * 7/2014 Jin ..... E04H 15/42 135/156
9,140,030 B2 * 9/2015 Jin ..... E04H 15/42
2010/0059095 A1 * 3/2010 Hinz ..... E04H 15/54 135/120.1
2015/0068573 A1 * 3/2015 Jin ..... E04H 15/46 135/147
2019/0330876 A1 * 10/2019 Carter ..... E04H 15/32

FOREIGN PATENT DOCUMENTS

FR 2707686 A1 * 1/1995 ..... E04H 15/14
GB 2121850 A * 1/1984 ..... E04H 15/36
KR 20100092796 A * 8/2010
KR 101018641 B1 * 3/2011
KR 20130004378 U * 7/2013

* cited by examiner

*Primary Examiner* — David R Dunn
*Assistant Examiner* — Danielle Jackson
(74) *Attorney, Agent, or Firm* — Leavitt Eldredge Law Firm

(57) ABSTRACT

A tent cover system for providing improved ventilation and cooling is disclosed. The tent cover system includes a frame having a hub and a plurality of roof poles extending therefrom; a cover having a reflective topside and a blackout underside; a plurality of vertical poles configured to hoist the cover above a tent, thereby creating an airspace therebetween; and a plurality of guy lines configured to removably secure the cover to a ground surface.

1 Claim, 5 Drawing Sheets

TENT COVER SYSTEM AND METHOD OF USE

CROSS REFERENCE TO RELATED APPLICATIONS

This application claims the benefit of U.S. Provisional Application 63/120,352, filed Dec. 2, 2020, of which is hereby incorporated by reference in its entirety.

BACKGROUND

1. Field of the Invention

The present invention relates generally to tents, and more specifically to a tent cover system that utilizes a cover having a reflective top side and a blackout underside for improved cooling thereunder.

2. Description of Related Art

Tents are well known in the art and are effective means to provide portable shelters for various outdoor activities. Conventional tents are made of lightweight material that is stretched over and sustained by a frame. Typically, tents form a closed structure to prevent environmental elements from entering therein. Because of this, the temperature inside the tent increases especially during summer seasons. One solution has been to incorporate reflective material to reflect thermal radiation away from the tent. However, these reflective materials do not allow ventilation, thus the air within the tent becomes stagnant.

Accordingly, although great strides have been made in the area of tents, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
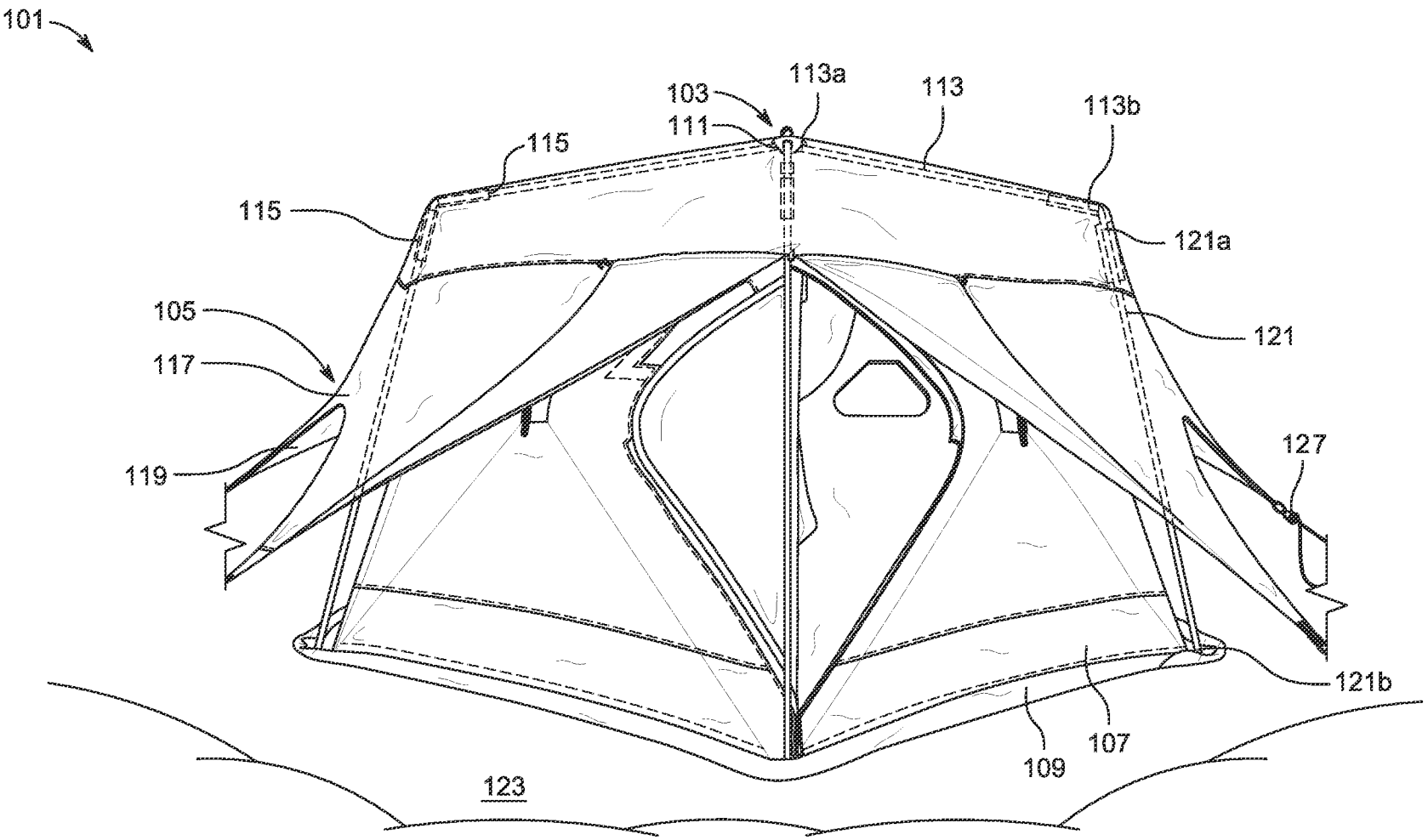
FIG. 1A is a front view of a tent cover system in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional tents. Specifically, the system of the present invention provides for a cover that improves cooling and ventilation of a tent placed thereunder. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
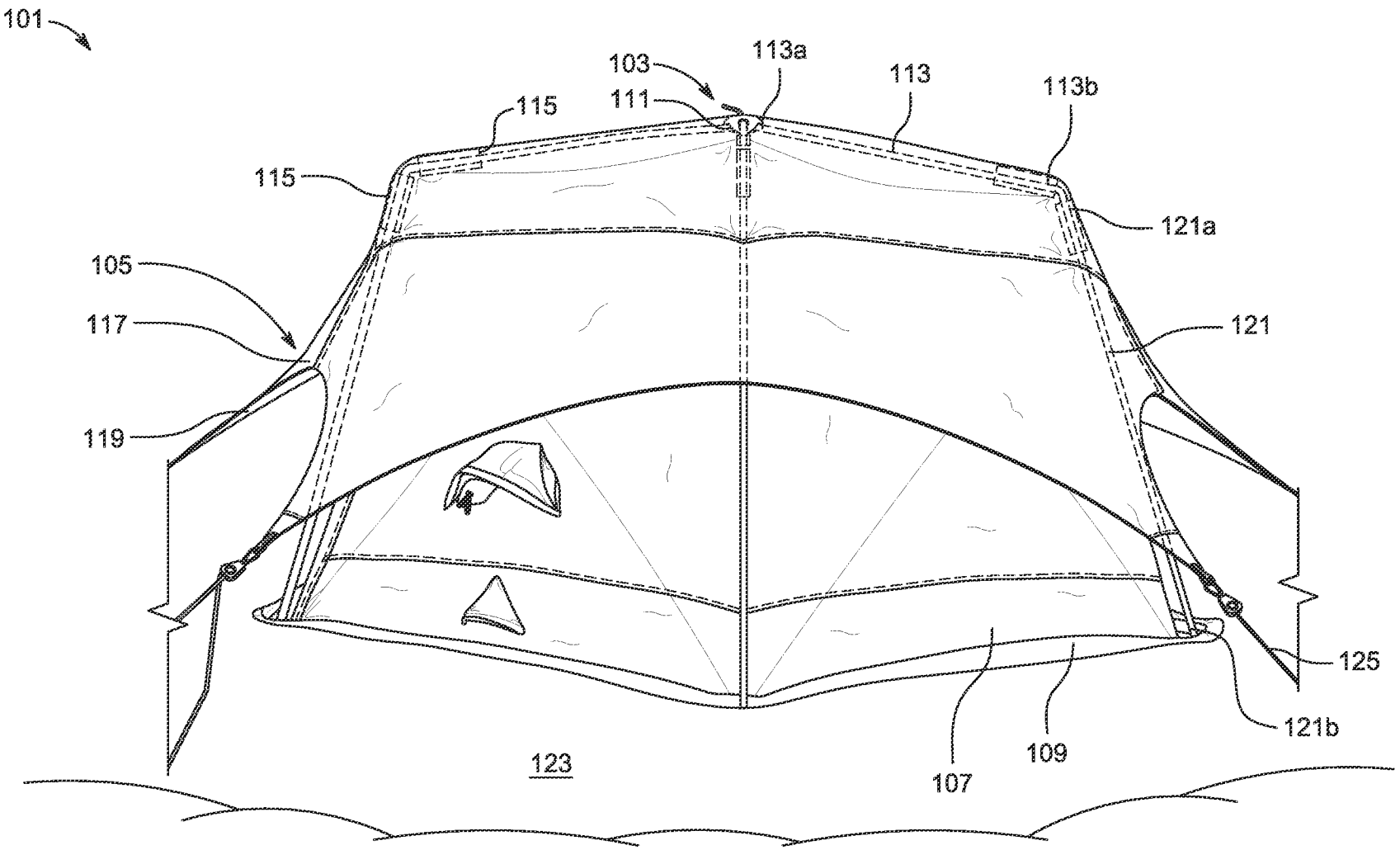
FIG. 1B is a rear view of a tent cover system in accordance with a preferred embodiment of the present invention.

Referring now to the drawings wherein like reference characters identify corresponding or similar elements throughout the several views, FIGS. 1A-1B depict a front and a rear view, respectively, of a tent cover system 101 in accordance with a preferred embodiment of the present application. It will be appreciated that the tent cover system 101 overcomes one or more of the above-listed problems commonly associated with conventional tents.

In the contemplated embodiment, the tent cover system 101 includes a frame 103 that suspends a cover 105 over a tent 107 and a skirt 109. It should be appreciated that the tent cover system 101 may vary based on aesthetical, functional, or manufacturing considerations.

The frame 103 comprises of a hub 111 having a plurality of roof poles 113 extending therefrom. It should be appreciated that the hub 111 is shown on the top center of the frame 103. In addition, it should be appreciated that the plurality of roof poles 113 pulls the cover 105 outwardly, creating a dome-shape appearance for the cover 105. Each roof pole 113 includes a proximal end 113*a* and a distal end 113*b*. In the preferred embodiment, the proximal ends 113*a* are permanently engaged with the hub 111, thereby reducing assembly time. The distal ends 113*b* are removably inserted into a plurality of pole pockets 115.

The cover 105 comprises of a reflective top side 117 and a blackout underside 119. The top side 117 is made of any material suitable to reflect sunlight such as aluminum and/or mylar, as non-exclusive examples. The underside 119 is made of any material suitable to prevent light from penetrating therethrough. For example, the underside 119 can include natural fiber material (e.g., cotton, wool, hemp, etc.), synthetic fiber material (e.g., polyester microfiber, nylon, rayon, etc.), or a combination thereof (e.g., polyester and cotton blend).

The skirt 109 is coupled to the underside of the tent 107. The skirt 109 includes a plurality of grommets 401 (not shown, see FIG. 4). It should be appreciated that the skirt 109 may be integrally formed as part of the tent 107 or it may be separately formed and engaged therewith (e.g., by sewing, adhesives, mechanical connectors, or other coupling techniques). In alternative embodiments, the skirt 109 may be eliminated.

The plurality of pole pockets 115 are coupled to the underside of the cover 105. It should be appreciated that the pole pockets 115 may be integrally formed as part of the cover 105 or it may be separately formed and engaged therewith (e.g., by sewing, adhesives, mechanical connectors, or other coupling techniques).

The tent cover system 101 also includes a plurality of vertical poles 121 configured to hoist the cover 105 above the tent 107. Each vertical pole 121 includes a proximal end 121*a* and a distal end 121*b*. The proximal ends 121*a* are inserted into the plurality of pole pockets 115 and the distal ends 121*b* are inserted into a ground surface 123.

The tent cover system 101 also includes a plurality of guy lines 125 configured to removably secure the cover 105 to the ground surface 123.

The tent cover system 101 also includes one or more fasteners 127 to allow a portion of the cover 105 to be lifted and secured thereto, as shown in FIG. 1A. This allows for easier ingress and egress of the tent 107. In the preferred embodiment, the one or more fasteners 127 are hook-and-loop fasteners.

The tent cover system 101 also includes a footprint having a plurality of grommets. The footprint provides for protection from rocks, gravel, condensation, sticks, etc., for the tent 107, thereby extending the lifespan of the tent 107. The footprint is made of any material suitable to protect the tent 107 such as canvas, polyester, nylon, polypropylene, polyethylene, and/or vinyl, as non-exclusive examples.

Figure 2:
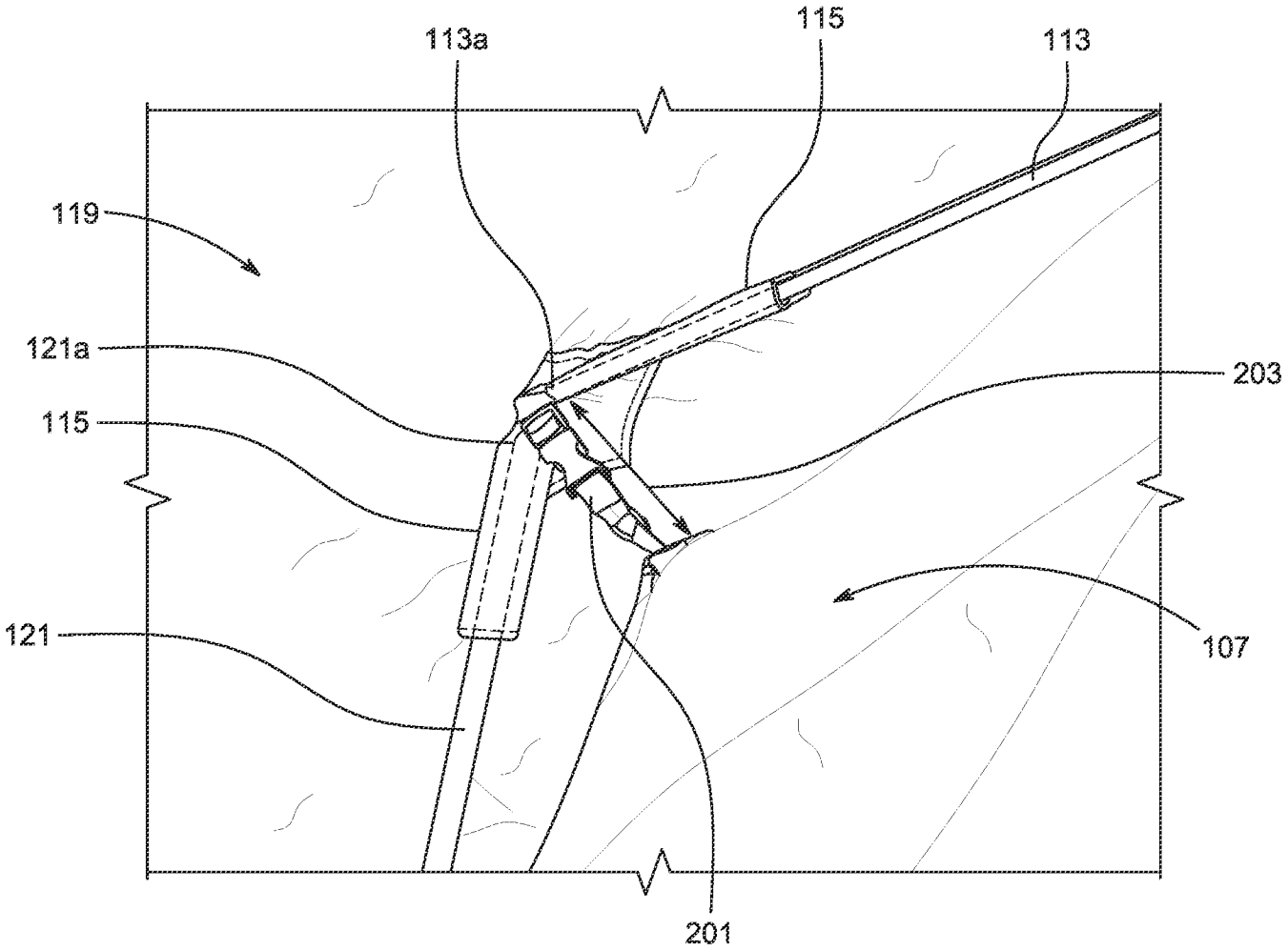
FIG. 2 is a close-up view of the pole pockets of FIGS. 1A and 1B.

In FIG. 2, a close-up view of the plurality of pole pockets 115 is depicted. As shown, the tent cover system 101 further includes a plurality of fasteners 201 configured to removably couple the underside 119 of the cover 105 to the tent 107. It should be appreciated that the plurality of fasteners 201 prevent the cover 105 from becoming dislodged from the frame 103 and tent 107. In addition, it should be appreciated that although the plurality of fasteners 201 may be any type of fastening mechanism including, without limitation, buckles, zippers, snaps, hook-and-loop fasteners, hook-and-eye fasteners, other fasteners, or the like. In the preferred embodiment, the fasteners are buckles, as shown in FIG. 2.

When the proximal ends 121*a* of the plurality of vertical poles 121 are inserted into the plurality of pole pockets 115, an airspace 203 is created between the cover 105 and tent 107. It should be appreciated that the length of the airspace 203 can vary.

Figure 3:
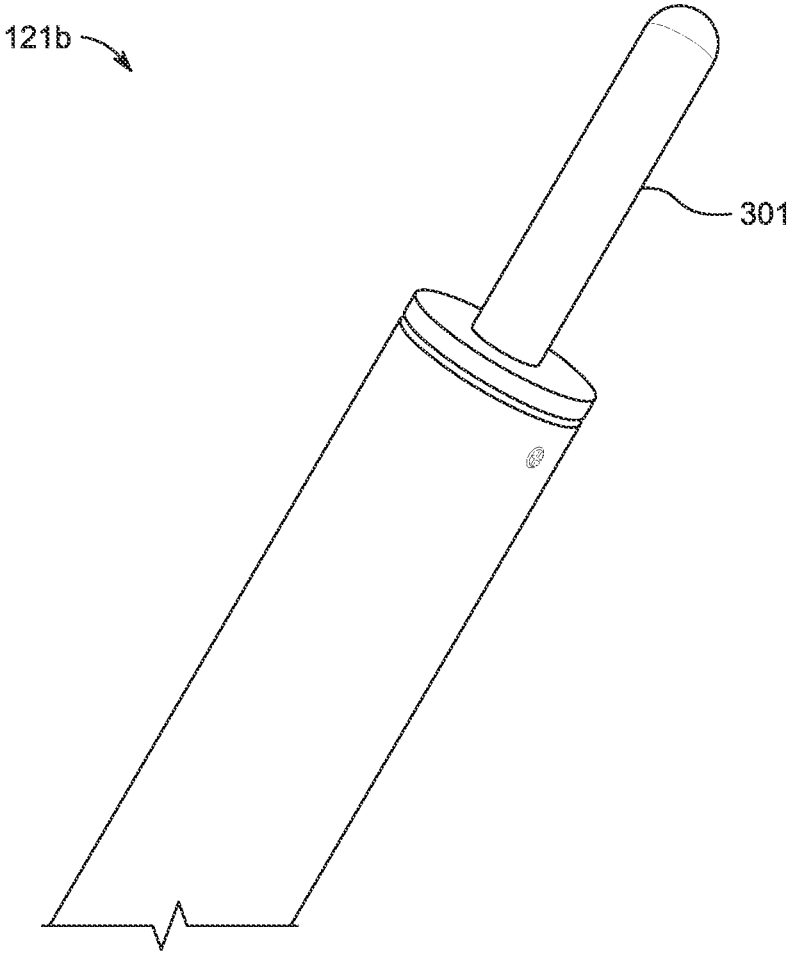
FIG. 3 is a close-up view of the distal end of the vertical poles of FIGS. 1A and 1B.

In FIG. 3, a close-up view of a distal end 121*b* of the plurality of vertical poles 121 is illustrated. As shown, the distal end 121*b* includes a spike 301 to penetrate into the ground surface 123, thereby securing the cover 105 to the ground surface 123. In the preferred embodiment, the spike 301 includes measurements of approximately 2 inches.

Figure 4:
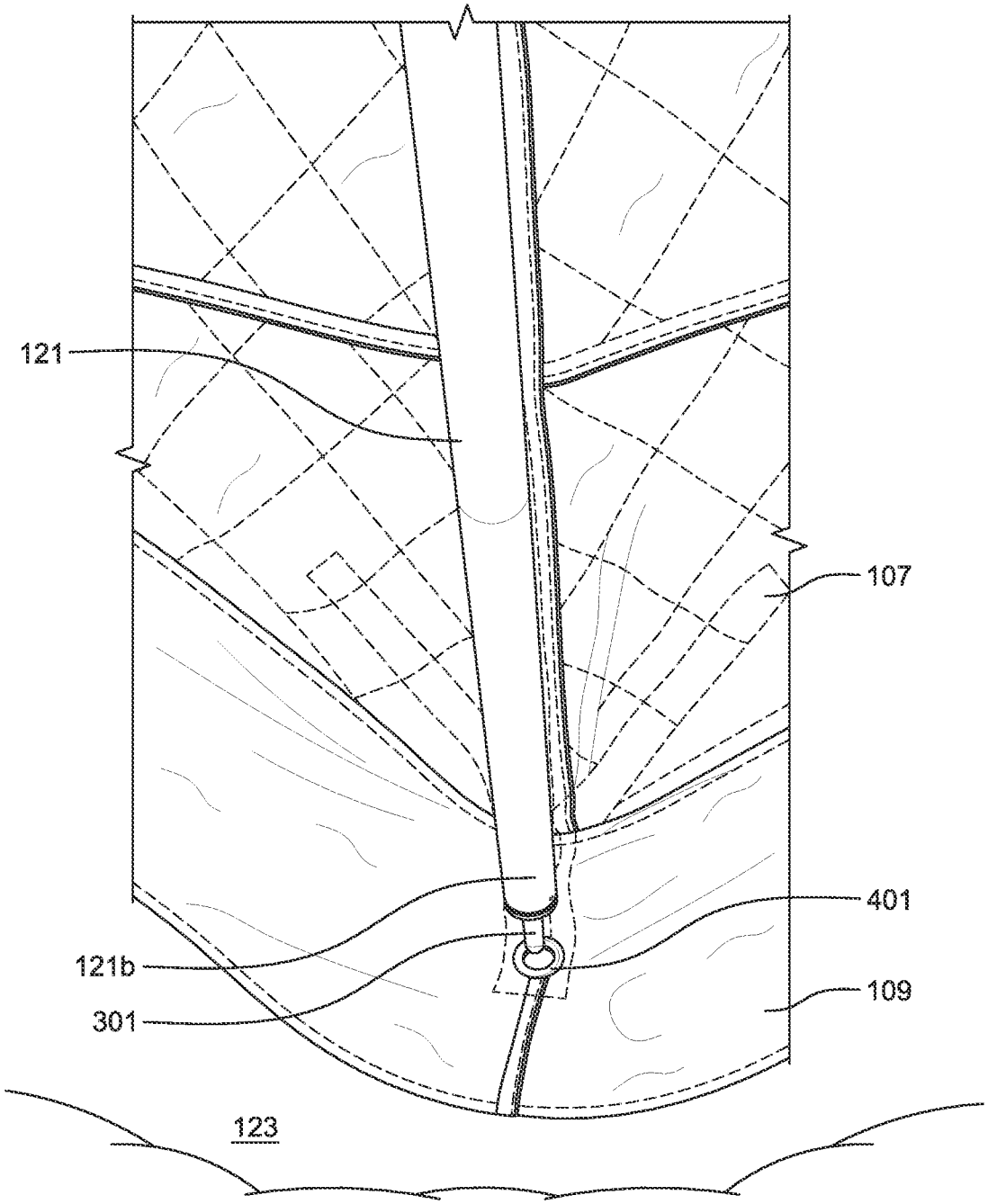
FIG. 4 is a close-up view of the distal end of the vertical poles of FIGS. 1A and 1B, illustrating the distal end inserting into a grommet.

In FIG. 4, a close-up view of the distal end 121*b* inserting into a grommet 401 is depicted.

It should be appreciated that during use, after the footprint is laid over the ground surface 123, the tent 107 is placed over the footprint. In addition, it should be appreciated that the plurality of grommets of the footprint align with the plurality of grommets 401 of the skirt 109 such that the distal ends 121*b* may insert therethrough and into the ground surface 123.

It should also be appreciated that the system of the present invention is considered unique for the following reasons: (1) the utilization of both the reflective topside and the blackout underside of the cover that provides for improved cooling thereunder; and (2) the airspace created between the cover and the tent for improved airflow therebetween.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A tent cover system, comprising:

a tent;

a tent skirt, the tent skirt coupled to an underside portion of the tent, the tent skirt having a plurality of grommets;

a cover, the cover having:

a reflective topside;

a blackout underside;

a plurality of pole pockets coupled to the blackout underside;

a plurality of fasteners coupled to the blackout underside, the plurality of fasteners configured to removably couple the cover to the tent; and one or more fasteners configured to hold and secure a portion of the cover onto itself;

a frame, the frame having:

a hub;

a plurality of roof poles having a proximal end and a distal end;

wherein the proximal end is engaged with the hub;

a plurality of vertical poles configured to hoist the cover above the tent, thereby creating an airspace therebetween, the plurality of vertical poles having:

a proximal end; and a distal end, the distal end having a spike extending therefrom;

a plurality of guy lines configured to removably secure the cover to a ground surface; and a footprint configured to protect the underside portion of the tent, the footprint having a plurality of grommets, wherein the plurality of grommets aligns with the plurality of grommets of the tent skirt.

* * * * *